United States Patent [19]

Petry et al.

[11] 3,931,936

[45] Jan. 13, 1976

[54] APPARATUS FOR CRUSHING SOLIDS IN A LIQUID MEDIUM

[75] Inventors: Eston F. Petry, McMurray, Pa.; Ronald W. Umphrey, Ponca City, Okla.

[73] Assignee: Continental Oil Company, Ponca City, Okla.

[22] Filed: June 5, 1974

[21] Appl. No.: 476,349

[52] U.S. Cl. ..... 241/46.15; 241/236

[51] Int. Cl.[2] ..... B02C 23/36

[58] Field of Search ..... 241/15, 20, 21, 27, 38, 241/43, 44, 46 R, 46.02, 46.04, 46.06, 46.08, 46.11, 46.17, 186.1, 190, 227, 236

[56] References Cited

UNITED STATES PATENTS

| | | | |
|---|---|---|---|
| 871,063 | 11/1907 | Hodges | 241/236 X |
| 1,620,838 | 3/1927 | Seigle et al. | 241/46.02 X |
| 2,280,944 | 4/1942 | Foresman | 241/46 R X |
| 2,578,540 | 12/1951 | Gundlach | 241/236 |
| 2,753,161 | 7/1956 | Fye | 241/46.17 X |
| 3,474,973 | 10/1969 | Gundlach | 241/236 |
| 3,780,956 | 12/1973 | Miller, Jr. et al. | 241/46.17 |

*Primary Examiner*—Granville Y. Custer, Jr.
*Attorney, Agent, or Firm*—William J. Miller

[57] ABSTRACT

An apparatus for crushing solids in a liquid medium includes one or more pairs of cylindrical members rotatably journaled in the sidewalls of the liquid-filled vessel. The cylindrical members have crushing elements which are integrally provided on the surface of the cylindrical members. The material to be crushed is mixed with the solution in the liquid medium contained within the vessel and pumped out of the bottom of the vessel into a slurry line.

6 Claims, 6 Drawing Figures

APPARATUS FOR CRUSHING SOLIDS IN A LIQUID MEDIUM

BRIEF DESCRIPTION OF THE INVENTION

This invention comprises a hopper formed by sidewalls, end walls, and a sloping bottom. The hopper has a water inlet at the shallow end and a pump outlet at the deep end. Journaled roughly parallel with the surface of the water in the hopper is a plurality of cylindrical crushing elements which essentially consists of a cylindrical roll having crushing elements mounted on the outer periphery of the cylinder so that product passing between pairs of counter-rotating cylindrical crushing elements will be engaged by the teeth, mounted on the periphery, and sized or crushed to a dimension suitable for transportation to a slurry line. The crushing elements are mounted so that the water level is not higher than the upper surface of the cylindrical element nor lower than the bottom surface of the cylindrical element and preferably maintained at approximately the center line of the cylindrical elements.

The crushing elements being journaled in the fluid medium cause not only a substantial reduction in the noise inherent in crushing solids, but also a substantial reduction in the formation of dust which is always created when materials such as coal are broken in order to be sized. The reduction of dust in a mine leads to a substantial safety factor in the handling of coal materials. The invention contemplates either a single pair of crushing elements or a double pair of crushing elements with suitable deflector plates to direct the product between the counter-rotating pairs of crushing elements so that the material will be propelled when crushed into the hopper for proper mixing with the fluid.

BRIEF DESCRIPTION OF THE PRIOR ART

U.S. Pat. Nos. 1,619,004 to C. J. Sternkopf; 1,785,544 issued to G. H. Ellis; 1,620,838 issued to Seigle; and 3,596,841 issued to J. H. Perry relate to the invention disclosed herein. The Sternkopf, Ellis, and Perry patents all relate to crushers used in a liquid medium for the purpose of sizing or processing wood pulp. None of the crushers have sizing elements mounted on the periphery, nor do any of the crusher elements cooperate with a slurry hopper in order to mix the product with a fluid for purposes of sizing the product so that it can be transported through a slurry line.

The patent to Seigle discloses a pair of submerged rollers and a coal crushing apparatus. The teaching, however, in the Seigle patent is for the purpose of preventing the coal from being damaged due to falling after being crushed rather than for being processed for introduction into a slurry line. Furthermore, the Seigle patent does not indicate any criticality in the mounting of the rolls used for crushing the product.

DETAILED DESCRIPTION OF THE INVENTION

The same numbers will be used through the specification for similar elements.

Figure 1:
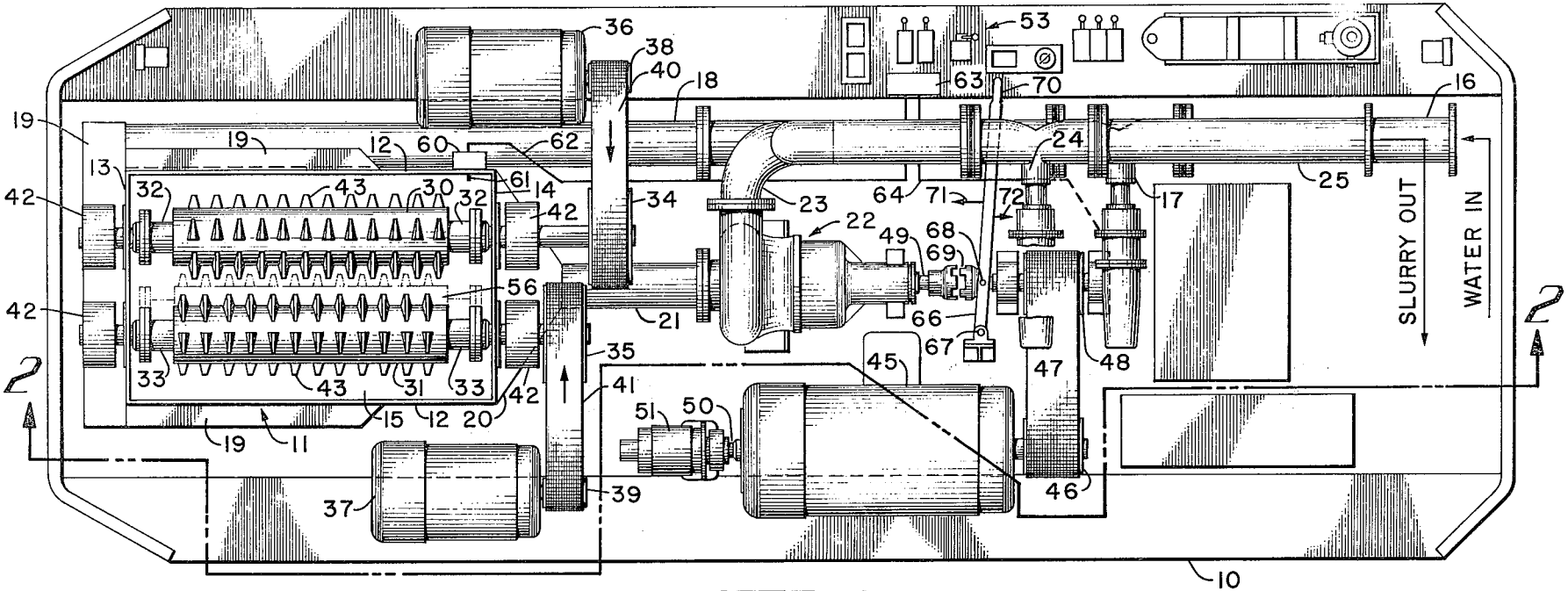
FIG. 1 is a top view of a portable crusher hopper assembly including the pumps and motors necessary for operating the vehicle.
Figure 2:
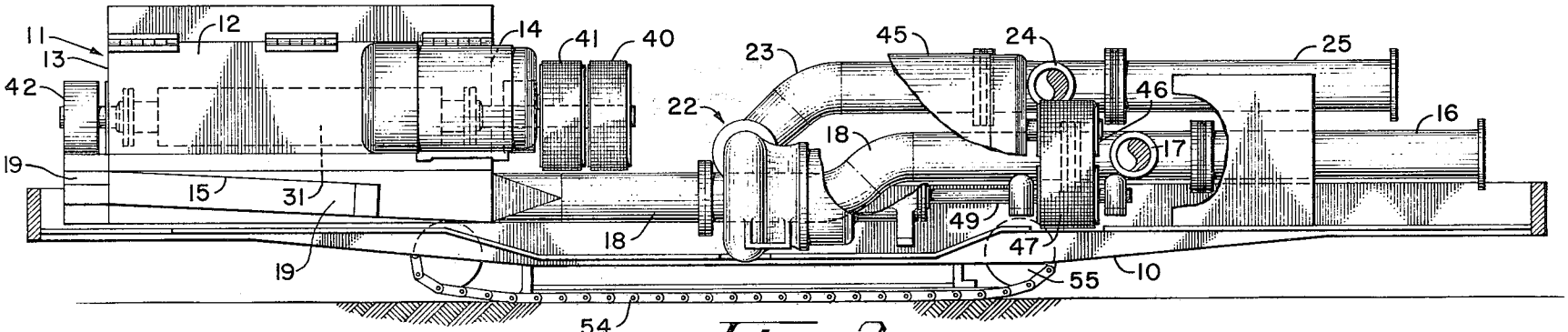
FIG. 2 is a side view and in partial section taken through lines 2—2 of the portable crusher slurry hopper system illustrated in FIG. 1.

Referring to FIGS. 1 and 2, a frame 10 has mounted thereon a slurry hopper 11 comprising sidewalls 12, end wall 13, a second end wall 14, and a bottom 15. Water is applied through an inlet pipe 16 to a valve 17, and through pipe 18 to manifold 19 which distributes the water into the slurry hopper and along the bottom surface. A pump outlet 20 is positioned in the lower end of hopper 11 and is connected to a pipe 21 to a pump generally referred to by arrow 22. The output from pump 22 passes through pipe 23 to a valve 24 and pipe 25. The slurry hopper system described herein is fully disclosed in U.S. Pat. application Ser. No. 389,272, filed Aug. 21, 1973, by David McCain entitled "Slurry Hopper System" now U.S. Pat. No. 3,845,990, issued Nov. 5, 1974.

Mounted inside the slurry hopper 11 are the crushing elements comprising cylindrical rolls 30 and 31 which are journaled by means of shaft 32 and 33, respectively, to pulleys 34 and 35, respectively. Motors 36 and 37 are coupled through pulleys 38 and 39, respectively, to belts or chains 40 and 41, respectively. Motors 36 and 37 may be any usual type motor adapted for driving crusher units; for example, electric or hydraulic. Flywheels 42 may be positioned on each of the rollers to assist in the breaking of the product as it passes into and between rolls 30 and 31. Contained on each of the rolls 30 and 31 is a plurality of teeth 43 which may be of any suitable type for engaging and breaking products such as coal. The seals, while illustrated, will not be described since they may be of any usual type seal to prevent water from escaping from the inside of hopper 11 around shaft 33 or 32, respectively. The dotted lines 56 illustrate the adjustments that can be made in the positioning of rolls 31 in order to crush the product to various desired sizes. Referring to the remainder of the elements mounted on frame 10 are motor 45 which is coupled through a pulley 46 and belt 47 and pulley 48 to a shaft 49 to pump 22. Motor 45 is also coupled to a shaft 50 to a hydraulic pump 51 used to move the vehicle which will be more specifically described in FIG. 2. Controls generally referred to by arrow 53 are used to control the movement of the mobile frame 10, the operation of the pump, and the various motors 36 and 37, for example. The controls are illustrated as being hand operated. It is of course obvious, however, that the controls can also be remotely controlled if desired.

Referring to FIG. 2, a side partial cross-section of FIG. 1 is illustrated and particularly illustrates a continuous track 54 used to propel the apparatus mounted on frame 10. Hydraulic motors 55 may be used to propel track 54 in either direction. Hydraulic motor 55 is coupled through lines not illustrated to hydraulic pump 51. A water level control means 60 is mounted on slurry hopper 11 and communicates through an element 61 to the inside of slurry hopper 11. The information thus communicated is transmitted through an electrical circuit 62 to an electrical control system 63 which in turn communicates through a wire 64 to valve 17. Control level sensor 60 may be of the float type or it may be a pipe mounted external to the hopper 11 through sidewalls 12 so that the internal water pressure in hopper 11 is communicated through the pipe to a diaphragm which is mounted on the externally mounted pipe. The pressure on the diaphragm will be indicative of the pressure inside the slurry hopper which will be a measure of the water level inside the slurry hopper 11.

OPERATIONS

Water entering pipe 16 is controlled by valve 17. When said valve is open, it will pass through pipe 18 into manifold 19 where the water is distributed throughout hopper 11. Water and crushed products are removed from hopper 11 through outlet 20, pipe 21, and pump 22 which will pressurize the slurry mixture and force it out pipe 23 through control valve 24 into pipe 25 and to the slurry handling system not disclosed in this application. Valve 24 may be used to close off the slurry lines at the pump if necessary and can be controlled at the manual controls 53 or automatic or remote controls mounted elsewhere remote from valve 24. Motor 45 rotates shaft 49 by rotation of pulley 46 which transfers motion to belt 47 and pulley 48 which is attached to shaft 49. A manual release lever 66 is pivoted at 67 and attached at 68 to a sliding coupling engaging means 69. A hand grip 70 may move the lever in the direction indicated by the arrow 71 in order to couple the rotation of pulley 48 to shaft 49 or in the direction of arrow 72 if the coupling 69 is to be disengaged from shaft 49. As product is being dropped in the space between rolls 30 and 31, rolls 30 and 31 are rotated by motors 36 and 37, respectively, through their pulleys 38, 39, and belts 40 and 41, and pulleys 34 and 35, respectively. As pulleys 34 and 35 rotate, shafts 32 and 33 will correspondingly rotate. Each of the belts is designed to move in the direction of the arrows indicated on top of the belt. As product falls between the crushing elements, teeth 43 will break the product to a predetermined maximum size where it falls and is mixed with the water inside the slurry hopper 11. Once the product is mixed, it is continually being removed by pump 22 as previously described. The entire apparatus mounted on frame 10 can be moved along the surface of the ground either inside or outside of mine, for example, by hydraulic pump 51 being hydraulically coupled to motors 55, causing track 54 to move in the desired direction either forward or backward, depending upon the setting of hand controls 53.

Figures 3, 5:
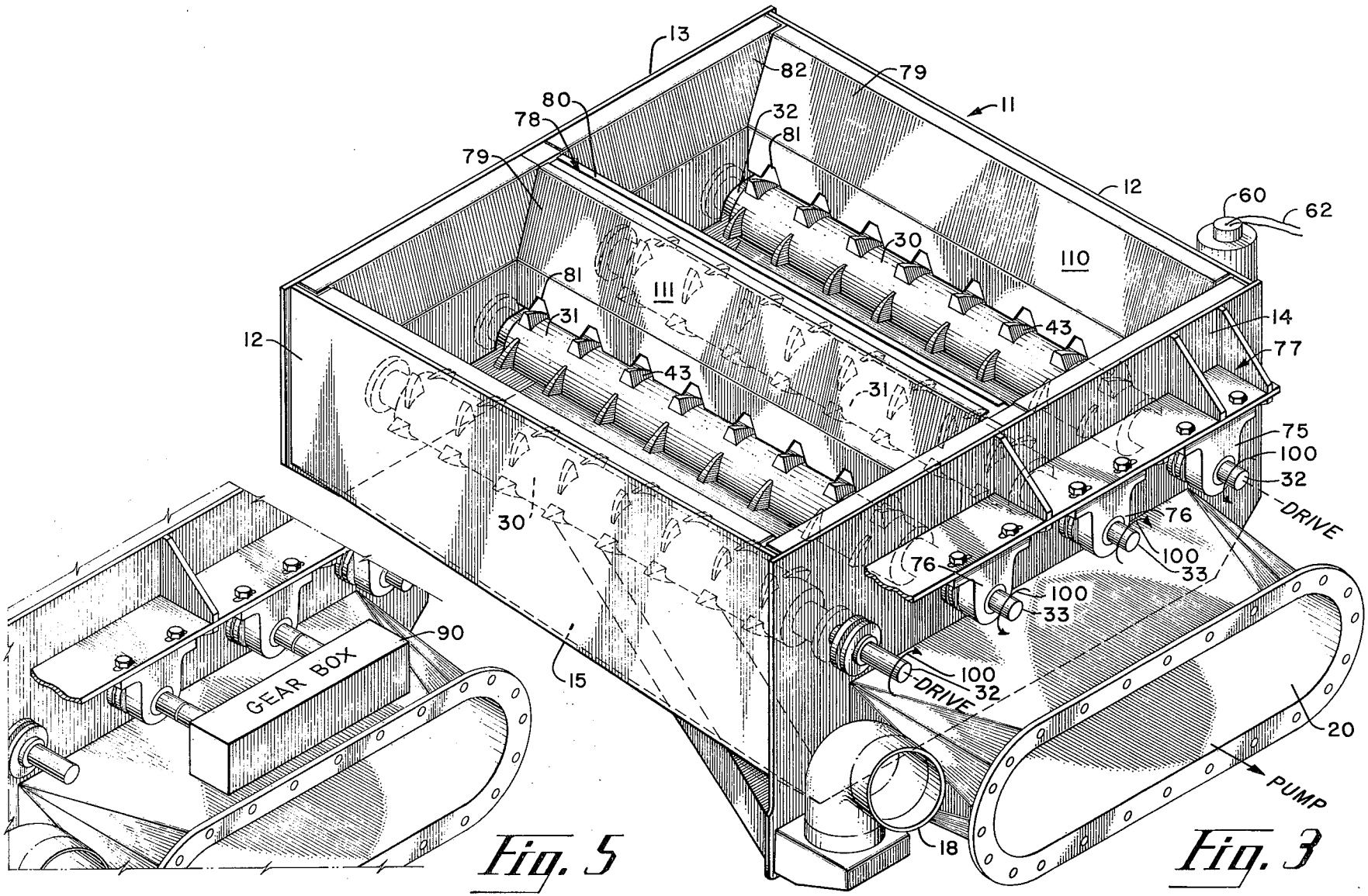
FIG. 3 is an orthogonal projection of the hopper and the crushing elements inside the hopper.
FIG. 5 is a partial view of the shaft extensions illustrated in FIG. 3 and illustrates the addition of a gearbox; and, FIG. 6 is a sectional view of the hopper system illustrated in FIG. 3 and illustrates the water line variations with respect to the crusher element in the slurry hopper system.
Figure 4:
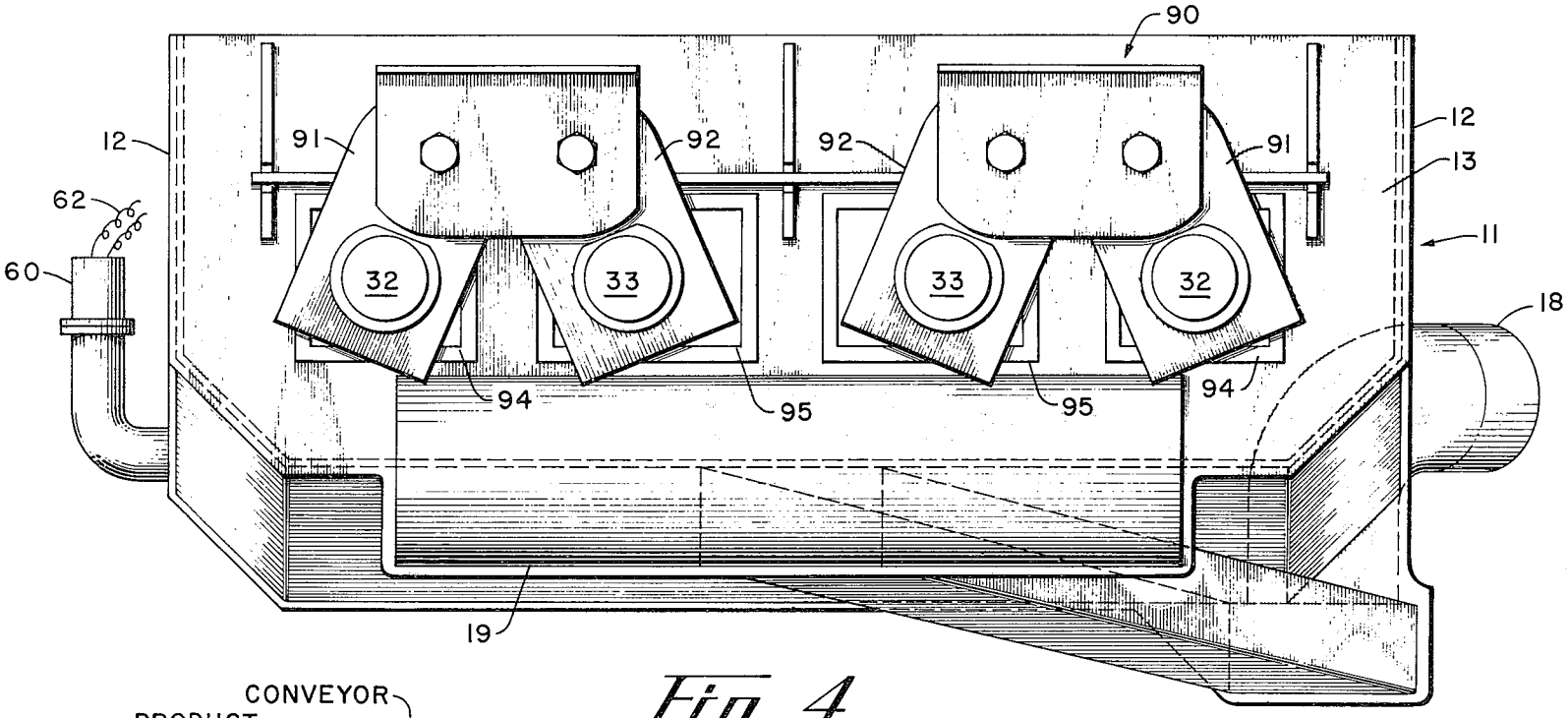
FIG. 4 is the end view of the slurry hopper illustrated in FIG. 3.

Referring to FIGS. 3, 4, and 5, a slurry hopper is illustrated which basically differs from the slurry hopper illustrated in FIGS. 1 and 2 by the inclusion of two pairs of counter-rotating pressure roller elements. In this embodiment, each of the pairs of crusher roll elements 30 and 31 is journaled through its respective shafts 32 and 33 in bearings 75 and 76, respectively, which are mounted on end wall 14. A bracket assembly referred to generally by arrow 77 is attached to end wall 14 and supports bearings 75 and 76. A generally A-shaped deflection apparatus, generally referred to by the arrow 78, is positioned between the cooperating pairs of cylindrical rolls 31. A-shaped deflector apparatus 78 comprises a first deflector 79 and a second deflector 80. Each of the deflectors has a notched portion 81 to permit passage of the teeth 43 through the deflector. On each sidewall 12 is likewise mounted a deflector plate 79, having similar notches 81 therein, to likewise permit passage of the teeth 43. End plates 82 are angled out from end walls 13 and 14 and tend to prevent material from bypassing the end of either pair of cylindrical rolls 30 and 31 in the region of shafts 32 and 33.

Referring in particular to FIG. 4, a gearbox, generally referred to by the number 90 is illustrated. Gearbox 90 has extending arms 91 and 92 which contain direct-drive gear means therein which are coupled respectively to shafts 32 and 33. Thus, rotation of shaft 32 will pass through gears in extensions 91 and 92 to shaft 33, maintaining synchronism of the two shafts and directly driving both shafts. Arms 91 and 92 are likewise adjustable so far as the spacing between shafts 32 and 33 is concerned, thereby permitting adjustment of the spacing between cylindrical rolls 30 and 31 (see FIG. 1). Plates 94 and 95 function as seals for shafts 33 and 32, respectively. Plate 95 is wider than plate 94 in order to accomodate movement of shaft 32 and yet maintain a seal between the inside and outside of hopper 11 on end wall 13.

In FIG. 5, a gearbox 90 is illustrated and may be a direct-drive gearbox if the spacing of shafts 33 and 32 remains stationary, or may be of the adjustable type gearbox illustrated in FIG. 4 if the shafts are to be moved as previously described. Arrows 100 illustrate the proper direction for rotation of each of the shafts 32 and 33. No driving means has been illustrated in FIG. 3 since it is substantially identical to that illustrated in FIG. 1.

OPERATIONS

The operation of the crusher hopper apparatus illustrated in FIGS. 3 through 5 is substantially identical to that illustrated and described in FIGS. 1 and 2. Material such as coal falling into the hopper partially filled with water which has entered pipe 18, will fall between rolls 30 and 31 and be broken by teeth 43 to a predetermined maximum size. Any coal falling into the hopper system will either enter the region referred to by number 110 or the region referred to by number 111. A paired roll sizing apparatus, however, has advantages over a single roll sizing apparatus. For example, if material falling into region 110, for example, should become compacted and not fall to the crusher immediately, the material will automatically spill over into region 111. Region 111 will take the maximum load for the period of time that region 110 is unable to take additional load or, for some reason, becomes temporarily blocked, for example, by the passage of a large piece of material and could, under normal conditions, create a situation where the crusher could not handle the desired maximum quantity of material. Thus, in the case of a single pair of crushing elements, if a large piece of coal, for example, were to fall between rolls 30 and 31, the hopper would momentarily be completely blocked, causing the material to fill up the hopper and to spill over the sides. However, with a second hopper area for region 111, should this occur, the material will automatically spill over into the other hopper which has sufficient capacity to handle the full load temporarily. In view of the above, it is obvious, of course, that two pairs of crushing elements and a hopper divided into two sections have distinct advantages and superiority over a hopper having a single pair of crushing elements.

WATER LEVEL CONTROL

Figure 6:
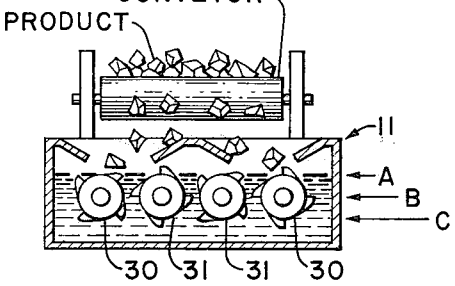

Referring to FIG. 6, a water level control is illustrated. It has been found by experimentation that a critical water level control must be maintained in the hopper assembly at all times if the apparatus is to maintain a maximum throughput. The preferred level of water is labeled B; that is, the water is through the rotational axis of each of the four rollers. Under these conditions, maximum product input is obtained along with maximum noise suppression and minimum cavitation. Also, suppression of the dust is adequate at this water level. If the water level should reach the position labeled A, the throughput of the crusher assembly is substantially reduced. If the water level should fall to C, substantial cavitation results, causing a reduction in throughput and an increase in noise and dust generation.

CONCLUSIONS

A two- and four-roll crushing unit combined with a slurry hopper has been illustrated. A hopper and crusher constructed in accordance with the teachings of this invention will result in substantial noise reduction during the crushing process, substantial dust reduction during the crushing process, and a maximum throughput of the system. It has been illustrated that water level control of this system must be maintained no higher than the tops of the rolls and no lower than the bottom of the rolls, and preferably at the rotational axis of the rolls if maximum throughput, along with noise and dust suppression, is to be accomplished.

It is obvious, of course, that changes and modifications may be made in the apparatus disclosed and still be well within the spirit and scope of the invention as described in the specification and appended claims. For example, additional rolls can be added, or larger rolls can be inserted depending upon the size of the hopper and the size of the space within the hopper. Other deflection plates can be added to prevent surface waves from developing during the crushing process and to assist in removal of the material after it has passed through the crushing unit. Additional water jets can be added. The various pump outlets can be modified in accordance with the particular pump used. Also, the teeth on the cylindrical rolls have been illustrated as being in line. It is obvious, of course, that if the rolls are driven in synchronism, the teeth can be placed in a staggered position around the rolls so that they intermesh as the rolls rotate.

What we claim is:

1. In a slurry hopper having sidewalls, first and second endwalls, and a bottom wherein said bottom slopes from said first endwall to said second endwall, a water inlet means at said first endwall for partially filling said slurry hopper with water, an outlet in said second endwall, an improvement comprising a product sizing unit having a plurality of cylindrical rolls journaled substantially parallel with the surface of the water in said slurry hopper, said cylindrical rolls including a plurality of spaced peripheral teeth along the length of said cylindrical rolls, means for counter-rotating adjacent rolls of said plurality of cylindrical rolls, and means for maintaining the level of said water in said slurry hopper between the upper surface and the lower surface of said plurality of cylindrical rolls.

2. An apparatus as described in claim 1 wherein said water level is maintained at or lower than the rotating axis of said plurality of rolls.

3. An apparatus as described in claim 1 wherein said plurality of cylindrical rolls comprises two rolls.

4. An apparatus as described in claim 1 wherein said plurality of cylindrical rolls comprises two pairs of cylindrical rolls and a deflector means positioned between and above said pairs of rolls and along the length of said rolls.

5. An apparatus as described in claim 4 including additional deflector means attached to the said sidewalls and end walls and extending towards said adjacent cylindrical rolls.

6. An apparatus as described in claim 4 wherein said water level is maintained substantially at the rotational axis of said cylindrical rolls.

* * * * *